US008869556B2

(12) United States Patent
Asscher et al.

(10) Patent No.: US 8,869,556 B2
(45) Date of Patent: Oct. 28, 2014

(54) JEWELRY PIECE OR RING

(75) Inventors: Lita Natascha Asscher, New York, NY (US); Mike Edward Asscher, Amsterdam (NL)

(73) Assignee: Stars of Africa Corp., New York, NY (US)

( * ) Notice: Subject to any disclaimer, the term of this patent is extended or adjusted under 35 U.S.C. 154(b) by 222 days.

(21) Appl. No.: 12/616,586

(22) Filed: Nov. 11, 2009

(65) Prior Publication Data

US 2011/0056243 A1 Mar. 10, 2011

Related U.S. Application Data

(63) Continuation of application No. PCT/US2009/056386, filed on Sep. 9, 2009.

(51) Int. Cl.

| | |
|---|---|
| ***A44C 9/00*** | (2006.01) |
| ***A44C 17/00*** | (2006.01) |
| ***A44C 27/00*** | (2006.01) |
| ***A44C 15/00*** | (2006.01) |

(52) U.S. Cl.

CPC ..... *A44C 9/0053* (2013.01); *A44C 27/00* (2013.01); *A44C 15/00* (2013.01)

USPC ..... 63/15; 63/32

(58) Field of Classification Search

USPC ..... 63/1.12, 1.13, 1.14, 1.16, 15, 3, 26, 32, 63/1.11; D11/26, 3, 89–91, 34; 40/406, 40/409, 410

See application file for complete search history.

(56) References Cited

U.S. PATENT DOCUMENTS

| | | | | |
|---|---|---|---|---|
| 506,268 | A * | 10/1893 | Steidlitz | 63/26 |
| 899,516 | A * | 9/1908 | Dover | 63/28 |
| 1,035,909 | A * | 8/1912 | Robbins | 63/28 |

(Continued)

FOREIGN PATENT DOCUMENTS

| | | |
|---|---|---|
| GB | 767897 A | 12/1957 |
| JP | 06-086705 | 3/1994 |
| KR | 20-0415097 | 4/2006 |
| WO | 9908561 A1 | 2/1999 |

OTHER PUBLICATIONS

Eva Martin, "Snowglobe ring", Mar. 20, 2009, www.evamartin.com, p. 1.*

(Continued)

*Primary Examiner* — Victor Batson
*Assistant Examiner* — Abigail Morrell
(74) *Attorney, Agent, or Firm* — Martin Fleit; Paul D. Bianco; Fleit Gibbons Gutman Bongini & Bianco PL

(57) ABSTRACT

The invention provides a piece or article of jewelry that is made from a metal support including a plate having an upper surface and lower surface with an upstanding peripheral rim on the upper surface that is mounted on the support to be normal to the viewer, and a sealed transparent dome filled with a liquid of a preselected specific gravity and viscosity into which is immersed a plurality of objects of given density. The dome is sealed to the upper surface of the plate and to the upstanding rim. The plurality of objects disperses in the liquid responsive to agitation or disturbance and will slowly settle by gravity to the lowest point of the dome when the agitation or disturbance ceases. The invention also provides a method of making the article of jewelry.

12 Claims, 2 Drawing Sheets

(56) References Cited

U.S. PATENT DOCUMENTS

| | | | | | |
|---|---|---|---|---|---|
| 1,177,893 | A | * | 4/1916 | Paye | 63/26 |
| 1,328,949 | A | * | 1/1920 | Dover | 63/28 |
| 1,421,329 | A | * | 6/1922 | Welch | 63/38 |
| 1,730,257 | A | * | 10/1929 | Welch | 63/32 |
| 1,827,695 | A | * | 10/1931 | Welch | 63/32 |
| 1,850,190 | A | * | 3/1932 | Welch | 63/32 |
| 1,912,602 | A | * | 6/1933 | Stonberg | 63/32 |
| 1,943,658 | A | * | 1/1934 | Dyckma | 428/51 |
| 1,972,726 | A | * | 9/1934 | Witte | 63/26 |
| 2,145,071 | A | * | 1/1939 | Cave | 63/3 |
| 2,161,506 | A | * | 6/1939 | De Caracena | 63/26 |
| 2,220,038 | A | * | 10/1940 | Kreisler et al. | 40/725 |
| 2,220,389 | A | * | 11/1940 | Berg | 359/545 |
| D131,948 | S | * | 4/1942 | Schwartz | D11/28 |
| 2,394,794 | A | * | 2/1946 | Manne | 63/15 |
| 2,419,520 | A | * | 4/1947 | Tessler | 63/28 |
| 2,584,087 | A | * | 1/1952 | Barbieri | 63/1.12 |
| 2,596,965 | A | * | 5/1952 | Troy | 2/239 |
| 2,605,032 | A | * | 7/1952 | Hunt et al. | 223/109 R |
| 2,674,107 | A | * | 4/1954 | Bodnar | 63/29.1 |
| 2,686,642 | A | * | 8/1954 | Dobarganes et al. | 248/523 |
| 2,959,039 | A | * | 11/1960 | Jefferies | 63/14.5 |
| 3,270,525 | A | * | 9/1966 | Sellers | 63/1.15 |
| D246,354 | S | * | 11/1977 | Durante | D11/36 |
| 4,142,383 | A | * | 3/1979 | Eberhart | 63/23 |
| 4,176,469 | A | * | 12/1979 | Timco | 434/126 |
| 4,249,393 | A | * | 2/1981 | Ciambra | 63/12 |
| 4,763,489 | A | * | 8/1988 | Strong | 63/4 |
| 5,006,375 | A | * | 4/1991 | Mangan | 428/13 |
| 5,156,550 | A | * | 10/1992 | Alexander | 434/370 |
| 5,232,752 | A | * | 8/1993 | Crespi et al. | 428/15 |
| 5,258,210 | A | * | 11/1993 | Chalfin | 428/28 |
| 5,491,916 | A | * | 2/1996 | Ingram et al. | 40/410 |
| 5,502,908 | A | * | 4/1996 | Powell et al. | 40/410 |
| 5,887,448 | A | | 3/1999 | Gilbert et al. | |
| 5,989,936 | A | * | 11/1999 | Smith et al. | 438/106 |
| 6,003,228 | A | * | 12/1999 | Riggio | 29/896.41 |
| D420,932 | S | * | 2/2000 | Shinohara | D11/26 |
| 6,027,774 | A | * | 2/2000 | Fine et al. | 428/14 |
| 6,065,640 | A | * | 5/2000 | Ho et al. | 222/78 |
| 6,138,870 | A | * | 10/2000 | Lin | 222/78 |
| 6,268,027 | B1 | * | 7/2001 | Wu | 428/13 |
| 6,308,443 | B1 | * | 10/2001 | Lin | 40/406 |
| 6,455,140 | B1 | | 9/2002 | Whitney et al. | |
| 7,017,369 | B2 | * | 3/2006 | Roberts-Shea | 63/15 |
| 7,228,716 | B2 | * | 6/2007 | Roberts/Shea | 63/15 |
| 2003/0003301 | A1 | | 1/2003 | Whitney et al. | |
| 2005/0086844 | A1 | * | 4/2005 | Niester | 40/800 |
| 2005/0166638 | A1 | * | 8/2005 | von Peterffy-Rolff de Erney | 63/40 |
| 2008/0173045 | A1 | | 7/2008 | Turner | |
| 2009/0235689 | A1 | * | 9/2009 | Slowinski | 63/15 |

OTHER PUBLICATIONS

Indee, "Snow Globe Ring", Dec. 18, 2008, www.theartzoo.com, pp. 1-3.*

Katherine, "Snow Globe Ring", Dec. 27, 2005, www.popgadget.net, p. 1.*

International Search Report mailed Mar. 3, 2010 for PCT/US09/056386 filed Sep. 9, 2009.

Written Opinion of the International Searching Authority mailed Mar. 3, 2010 for PCT/US09/056386 filed Sep. 9, 2009.

English translation of Chinese Office Action dated Oct. 8, 2013.

Supplementary European Search Report for PCT/US2009/056386 dated Apr. 26, 2013.

* cited by examiner

JEWELRY PIECE OR RING

BACKGROUND OF THE INVENTION

1. Field of the Invention

The present invention relates to jewelry and more particularly to jewelry pieces or articles including rings, brooches, pendants, necklaces, bracelets, earrings, cuff links, pins, watches and the like, and to the method for making same.

2. Prior Art

Many designs exist for pieces of jewelry, as the public desire for new and unique pieces or articles of jewelry is great and inexhaustible.

SUMMARY OF THE INVENTION

The present invention provides a unique and novel technically designed piece or article of jewelry different from what has existed before. In a preferred embodiment, the piece of jewelry is a ring, however, the inventive concept can be carried out in a variety of jewelry pieces including, but not limited to, rings, brooches, pendants, necklaces, bracelets, earrings, cuff links, pins, watches and the like. The present invention also concerns the method of making the unique and novel technically designed piece of jewelry The novel and unique piece or article of jewelry according to the present invention can be embodied in a ring that consists of a finger band that is formed to hold at its top a metal plate with a peripheral upstanding rim or flange. A transparent sealed dome, containing a liquid of a preselected density, specific gravity and viscosity and a plurality of small solid objects, is fixed to the metal plate surrounded by the rim or flange. The solid objects tend to float or suspend in the liquid, but being of higher density and specific gravity will slowly settle due to the viscosity of the liquid and due to gravity. If the ring is moved or the orientation is changed, the inertia of the settled objects will be disturbed and they will disperse in the liquid. When the ring becomes stationary or of very slow movement, the objects will slowly settle to the lowest point due to gravitational influences. The metal of the ring is preferably a precious metal, such as, gold, platinum, silver or alloys thereof. The objects are preferably small cut diamonds, but can also be small cut or uncut precious or semi-precious stones. In a less preferred and less expensive version of the jewelry piece, the metal can be selected from any metal used for jewelry and the objects can be of any inexpensive material that will show through the transparent dome and the liquid can be any transparent liquid having the properties so that the objects and liquid will interact in the manner described above.

The method of the invention consists of the steps of first making the base or support of the piece or article of jewelry consisting of e.g. a ring band and metal plate with upstanding peripheral rim, then preparing the transparent dome and transparent plate for sealing the dome by coating with a release agent, then after drying the release agent coating, turning the dome upside down and inserting stone, the diamonds into the interior space, then sealing the transparent plate to the dome, then filling the dome via a hole in the transparent plate with a transparent silicone fluid, then sealing the hole and the interior space of the dome, then turning the dome right side up, then placing the dome on the cast ring and plate to fit within the rim and lie on the top surface of the plate, and then adhesively sealing in a transparent manner the dome via the transparent plate to the metal plate and to the inside surface of the rim via a peripheral outer surface region of the dome.

A further object of the invention is to provide a piece or article of jewelry comprising:

a. a metal support including a plate having an upper surface and lower surface with an upstanding peripheral rim on the upper surface that is mounted on the support to be normal to a viewer, and b. a sealed transparent dome filled with a liquid of a preselected specific gravity and viscosity into which is immersed a plurality of objects of given density, said dome being sealed to the upper surface of said plate and to the upstanding rim, c. wherein the plurality of objects will disperse in said liquid responsive to agitation or disturbance and will slowly settle by gravity to the lowest point of the dome when the agitation or disturbance ceases.

The piece of jewelry as described above is made with the support being a metal selected from the group consisting of gold, platinum, silver and alloys thereof, and preferably gold. The liquid is preferably silicone. The plurality of objects is preferably cut diamonds. The metal plate is circular and has a design embossed on its upper surface. The dome is preferably composed of a member selected from the group consisting of natural sapphire, synthetic sapphire, and sapphire glass, and combinations thereof. The piece or article of jewelry is preferably a ring made of gold, the metal plate is gold, the dome is sapphire, the liquid is silicone and the objects are diamonds.

The invention also provides a method of making a piece of jewelry comprising the steps of a. making a support including a metal plate with upstanding peripheral rim, b. preparing a transparent dome and a transparent plate for sealing the dome by coating with a release agent, c. turning the dome upside down and inserting small objects into the interior space, d. sealing the transparent plate to the dome, e. filling the dome via a hole in the transparent plate with a transparent silicone fluid of a preselected specific gravity and viscosity, f. sealing the hole and the interior space of the dome, g. placing the dome on the cast ring and plate to fit within the rim with the transparent plate lying on the top surface of the plate, and h. adhesively sealing in a transparent and liquid tight manner the dome via the transparent plate to the metal plate and to the inside surface of the rim via a peripheral outer surface region of the dome.

In the method described above, preferably, the material of the material of the support and metal plate is a metal selected from the group consisting of gold, platinum, silver and alloys thereof, the material of the dome is a member selected from the group consisting of natural sapphire, synthetic sapphire, and sapphire glass, and combinations thereof and the objects are cut diamonds.

Other and further object, advantages and features of the invention will become readily apparent from the following detailed description of preferred embodiments of the invention when taken in conjunction with the appended drawings.

DETAILED DESCRIPTION OF PREFERRED EMBODIMENTS OF THE INVENTION

Figure 1:
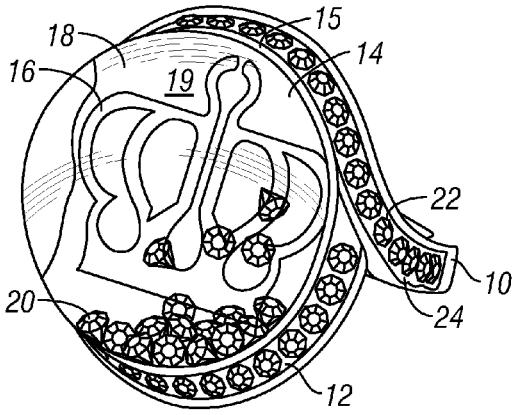
FIG. 1 is a perspective view of a first embodiment of a novel ring looking down at the top of the ring according to the present invention.
Figure 2:
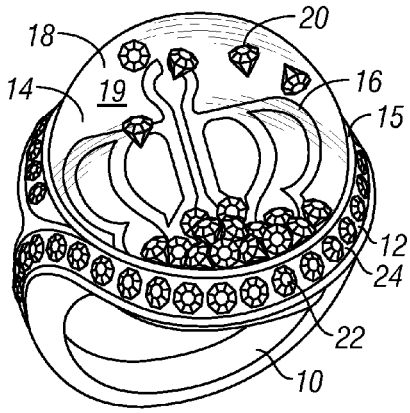
FIG. 2 is another perspective view of the novel ring shown in FIG. 1 looking down as seen from a different angle.

Referring now to the drawings, the invention will be described with reference to preferred embodiments. Shown in FIGS. 1 and 2 is a first embodiment, illustrated as a ring. The ring consists of a band or loop 10 through which a user's finger can pass so the ring can be worn, usually at the base of a selected finger. The band or loop 10 at its top integrally joins an annulus 12, the plane of which lies normal to the plane of the loop 10, or expressed differently, oriented at 90 degrees so that the annulus 12 will lie flat on or with respect to a finger wearing the ring and be normal to a viewer. A circular metal plate 14 having an upstanding rim or flange 15 is fixed to annulus 12 about its circumference or perimeter. The upper surface of the plate 14 is preferably embossed with a design 16, but a design can be placed on its surface in any other manner. A sealed transparent hollow hemispherical dome 18 contains a liquid 19 of preselected density and viscosity that fills the dome 18. A plurality of cut diamonds 20 are immersed in the liquid. The dome 18 is hemispherical and is closed at its bottom by a flat plate 60 (see FIG. 7) that is adhesively attached in a transparent manner to the upper surface of the metal plate 14. As shown in FIGS. 1 and 2 diamonds 22 are set into the outer surface 24 of the band or loop 10 and annulus 12.

Figure 3:
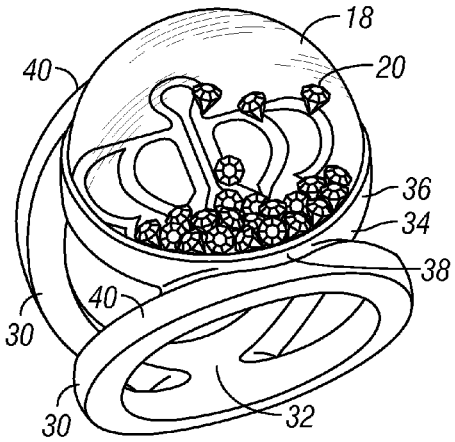
FIG. 3 is a perspective view of a second embodiment of a novel ring looking down at the top according to the present invention.
Figure 4:
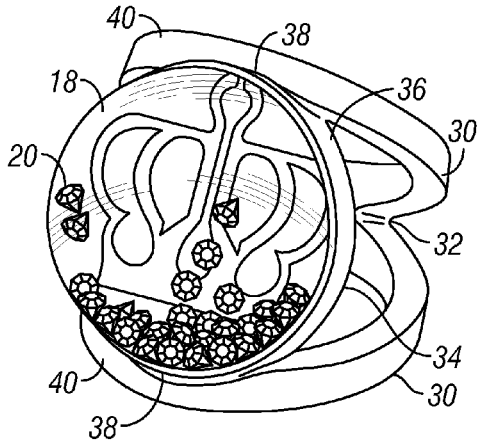
FIG. 4 is another perspective view of the novel ring shown in FIG. 3 looking down at a different angle.

FIGS. 3 and 4 show a second embodiment of a ring according to the present invention. The ring consists of two bands or loops 30 that are joined at the bottom as indicated by reference numeral 32 and are spaced apart at the top. A circular metal plate 34 having an upstanding rim 36 is integrally fixed at diametrically portions 38 to the upper portions 40 of the two bands or loops 30. The hemispherical dome 18 that is closed at its bottom by a flat plate 60, as described in conjunction with FIGS. 1 and 2, has a diameter that matches the inner diameter of the upstanding rim 36, and is adhesively attached in a transparent, liquid tight manner to the upper surface of the metal plate 34. The dome 18, as described, is filled with a liquid of preselected density and viscosity. A plurality of cut diamonds 20 are immersed in the liquid.

Figure 5:
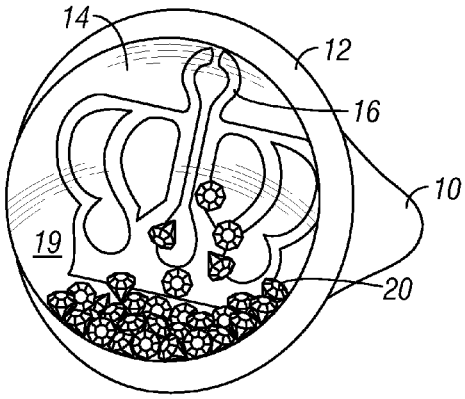
FIG. 5 is a perspective view of a third embodiment of a novel ring looking down at the top of the ring according to the present invention.

FIG. 5 shows a third embodiment, a ring of the same shape and configuration as the ring shown in FIGS. 1 and 2, but without the diamonds 24 set into or onto the outer surface 22 of the band or loop 10.

Figure 6:
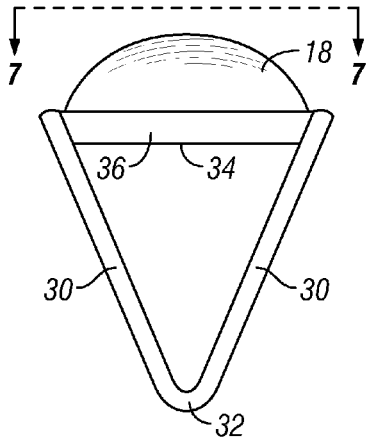
FIG. 6 is a side view of a ring as shown in FIGS. 3 and 4 according to the present invention.
Figure 7:
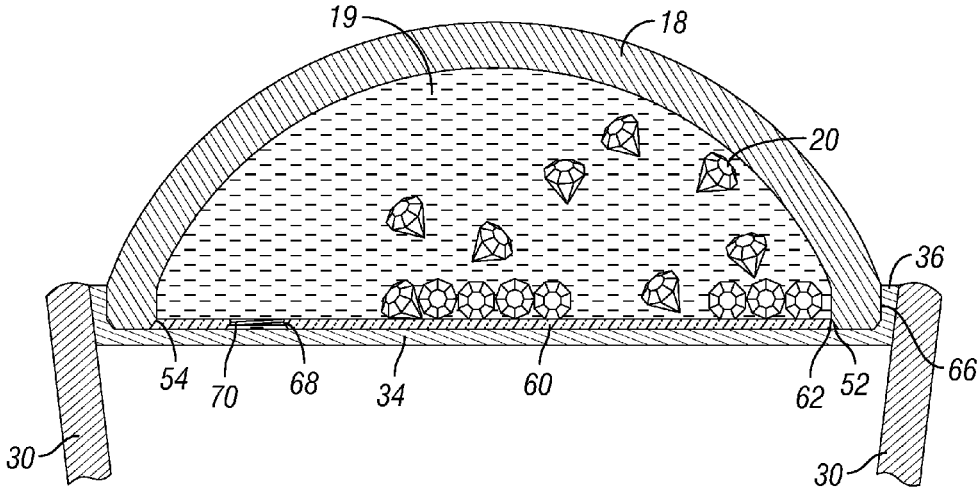
FIG. 7 is a partial vertical section taken along line 7-7 along a midplane through the ring structure shown in FIG. 6.

FIGS. 6 and 7 show details of the mounting of the dome 18 with respect to the ring shown in FIGS. 3 and 4. FIG. 6 is a side view showing the two bands or loops 30 joined at their bottom, see reference numeral 32, the flat circular plate 34 with rim 36 and the dome 18. FIG. 7 is a partial vertical section taken along the midplane of the ring showing the details of the dome 18 and the mounting of the dome 18 with respect to the flat circular metal plate 34 with upstanding rim 36. Dome 18, as described, is a hollow hemisphere, sealed by a thin transparent plate 60 that is adhesively attached to across the open mouth 62 of the hollow dome 18. Although the dome 18 is mainly hemispherical, the region at the outside surface adjacent the open mouth 62 is planar or flat or a straight surface 66 to match and fit with the upstanding rim 36. The inner edge of the open mouth of the dome 18 is beveled 52 and matches with a bevel 54 around the upper surface of the plate 60. Plate 60 has a small tapped hole 68 into which is threaded a flat-headed screw 70, countersunk, so that its head lies in the plane of the lower surface of the plate 60. The hole 68 enables the filling of the liquid 19 into the sealed interior space of the hemispherical dome 18. Prior to placement of and sealing of the plate 60, a plurality of cut diamonds 20 are placed in the dome 18. The plate 60 is sealed to the open mouth 62 of the dome 18 to enclose the interior space of the dome 18. Liquid is then fed via hole 68 into the interior space to fill same. The screw 70 is then threaded into the hole 68 closing same. The filling will not be 100% complete and a very small amount of air will be in the sealed interior space, but this is beneficial as allowance needs to be provided for thermal expansion and contraction of the fluid. Then the bottom plate 60 and the circular outer surface 66 of the dome 18 are adhesively attached in a liquid tight sealing manner to the top of the metal plate 34 and rim 36, respectively, in a transparent manner.

Although the ring is shown as having a circular top structure, the geometry of the jewelry piece or article can be any shape. Thus the plate 34 and dome 18 can be oblong, rectangular, or polygonal, and even irregularly shaped.

The selection of materials is very important. For a precious jewelry piece or article, the ring is made of gold, platinum, silver or an alloy thereof, with the preferred embodiment being 18 ct. gold (yellow, rose or white). The ring and circular plate 34 with rim 36, about 2 to 5 mm in height, can be cast by the lost wax process or any other method used to make jewelry, and may have pronged settings cast on the outer surface of the ring or band, as shown in FIGS. 1 and 2. Also, the ring can be cast separately from the plate and then the two joined afterwards. The plate is made with an embossed upper surface showing an embossed design 16.

The dome 18 is made of sapphire glass, pure sapphire or synthetic sapphire, all of which are transparent, and can vary in size from about 10 to 25 mm outer diameter. The thickness of the dome wall can vary from about 0.5 to about 3.0 mm. The inner diameter of the dome 18 can vary from about 8 to about 24 mm. However, these dimensions are only suggestive and they can vary beyond the limits noted, as the dimensions depend on the artistic and esthetic nature of the jewelry piece, and are usually left to the designer to specify, since a critical determinant of the piece is its appeal to a wearer.

The interior surface of the dome 18 and the plate 60 is coated with a suitable release agent to insure that the contained diamonds will not stick to the interior surface of the dome 18 or the plate 60. Any suitable material can be used for this purpose. However, a preferred material is Dry-Film RA/IPA made and sold by DuPont. This material consists of isopropyl 74-76%, Poly-TFE, Omega-Hydro-Alpha-(Methylcyclohexyl) 18-19% and Polytetraflouroethylene 6-7%.

The liquid used to fill the interior volume of the dome 18 is a silicone material having a specific gravity of about 0.94. A suitable material for the liquid is XIAMETER® PMX Silicone Fluid as sold by Dow Corning. The viscosity of the liquid can vary from about 25 to 32 cSt. In a preferred embodiment, the viscosity is about 30 cSt. The diamonds can be of any grade and are cut to a size of from about 1.1 mm to about 1.5 mm in diameter having a weight varying from about 0.01 ct to about 0.0175 ct. Diamond has a specific gravity (density) of 3.514 to 3.518. The plate 60 and screw 70 are composed of Plexiglas, which is transparent, coated as noted above. The adhesive material used to join the dome 18 and plate 34 can be any suitable material that is transparent and will make a secure liquid tight transparent joint. A typical material for this purpose is Epoxy Structuralit as made and sold by Pancol Adhesives.

For lesser preferred embodiments, such as a semi-precious jewelry piece, the ring can be made of a gold-plated base metal, such as nickel or chromium. It may also be made of any material used for jewelry, such as, silver, nickel, chromium or the like. The dome 18 can be any other transparent crystalline or non-crystalline material useable for jewelry. The plate 60 can be made of any suitable transparent material.

The method of the invention consists of the steps of first casting the metal components of the piece of jewelry, namely, ring and plate 34 with rim 36, then preparing the transparent dome 18 and plate 60 by coating with a release agent, then after drying the release agent coating, turning the dome upside down and inserting the diamonds into the interior space, then sealing the transparent plate 60 to the interior edge of the dome, as described, then filling the dome via the hole 68 with the transparent silicone fluid, then inserting and sealing the screw 70 to seal the interior space of the dome, then turning the dome right side up or not, then placing the dome on the cast ring and plate 34, or vice versa, so that plate 60 and dome 18 fit within the rim 36 and lie against the top surface of the plate 34, and then adhesively sealing in a transparent, liquid tight manner surface 66 of the dome 18 and the plate 60 to the inside surface of the rim 36 and to the circular plate 34, respectively.

Although the invention has been described and shown in terms of preferred embodiments, nevertheless changes and modifications will be evident to those of ordinary skill in the art, which do not depart from the spirit, scope and teachings of the invention. Such changes and modifications are deemed to fall within the purview of the appended claims to the invention.

What is claimed is:

1. A ring comprising:

a. a metal support having a band and a flat, rounded plate integrally mounted to the band, a plane of the plate lying normal to a plane of the band, the plate having an upper surface and a lower surface with an upstanding, peripheral rim normally projecting upwardly from the upper surface of the plate, a top edge of the rim substantially aligned with a top edge of the band;

b. a design embossed on the upper surface of the plate;

c. a transparent, hollow, dome having an open mouth, the dome composed of a material selected from the group consisting of natural sapphire, synthetic sapphire, sapphire glass, and combinations thereof;

d. a region of the dome at an outside surface adjacent the open mouth being planar to conform to the upstanding, peripheral rim of the flat, rounded plate;

e. a transparent plate co-extensive with and sealed to the flat, rounded plate, the transparent plate sealed at its periphery into the open mouth of the dome, lying coplanar with and sealing the dome in a liquid tight manner to the upstanding, peripheral rim of the flat, rounded plate;

f. a liquid of preselected specific gravity and viscosity, the liquid filling an interior of the dome; and g. a plurality of objects immersed in the liquid; whereby the plurality of objects disperse in the liquid responsive to agitation or disturbance and slowly settle by gravity to a lowest point of the dome after the agitation or disturbance ceases and together with the upper surface of the flat, rounded plate are visible through the dome.

2. The ring according to claim 1, wherein the metal of the support is selected from the group consisting of gold, platinum, silver, and alloys thereof.

3. The ring according to claim 2, wherein the metal is gold.

4. The ring according to claim 1, wherein the plurality of objects are cut diamonds.

5. The ring according to claim 1, wherein the flat, rounded plate is circular.

6. The ring according to claim 1, wherein the band is made of gold, the flat, rounded plate is made of gold, the liquid is silicone, and the plurality of objects are diamonds.

7. The ring according to claim 1, wherein an interior surface of the dome is coated with a release agent to prevent the plurality of objects from adhering to the interior surface of the dome.

8. The ring according to claim 1, wherein the band of the metal support comprises two ring bands joined at a point away from the plate.

9. The ring according to claim 1, wherein the transparent plate has a sealable hole.

10. The ring according to claim 9, wherein the sealable hole is internally threaded and sealable by a screw.

11. The ring according to claim 1, wherein a plurality of precious or semi-precious stones are set into the band.

12. The ring according to claim 1, wherein the plurality of objects are diamonds cut to a size from about 1.1 mm to about 1.5 mm in diameter and weighing between about 0.01 ct to about 0.0175 ct.

* * * * *